US005232125A

United States Patent [19]

Adams

[11] Patent Number: 5,232,125

[45] Date of Patent: Aug. 3, 1993

[54] NON-SPILL BOTTLE CAP USED WITH WATER DISPENSERS

[75] Inventor: Brian M. Adams, Newark, Calif.

[73] Assignee: Portola Packaging, Inc., San Jose, Calif.

[21] Appl. No.: 772,949

[22] Filed: Oct. 8, 1991

[51] Int. Cl.[5] ..... B67D 5/00

[52] U.S. Cl. ..... 222/83.5; 222/146.6; 141/330; 141/363

[58] Field of Search ..... 222/83.5, 146.6, 129, 222/484, 153; 141/18, 319, 330, 346, 363; 62/391

[56] References Cited

U.S. PATENT DOCUMENTS

| | | | |
|---|---|---|---|
| Re. 32,354 | 2/1987 | Savage | 222/81 |
| 233,668 | 10/1880 | Gardner . | |
| 261,914 | 8/1882 | Eberhard . | |
| 308,161 | 11/1884 | Howard et al. . | |
| 497,896 | 5/1893 | Ruppel . | |
| 538,554 | 4/1895 | Siebert, Jr. . | |
| 574,583 | 1/1897 | Springer et al. . | |
| 824,391 | 6/1906 | Toomey . | |
| 996,127 | 6/1911 | Patnaude . | |
| 1,018,924 | 2/1912 | Patnaude . | |
| 1,142,210 | 6/1915 | Wagner . | |
| 1,224,808 | 5/1917 | Sundell et al. . | |
| 1,246,879 | 11/1917 | Chadwick . | |
| 1,248,705 | 12/1917 | Pogue . | |
| 1,311,745 | 7/1919 | Beurmann . | |
| 1,319,439 | 10/1919 | Townsend . | |
| 1,538,483 | 5/1925 | Grantham . | |
| 1,645,127 | 10/1927 | Carnes . | |
| 1,700,632 | 1/1929 | Gay . | |
| 1,976,007 | 10/1934 | Cullen et al. . | |
| 2,252,543 | 8/1941 | Beeh . | |
| 2,597,250 | 5/1952 | Kollsman . | |
| 2,792,669 | 10/1956 | Jackson et al. . | |
| 2,811,272 | 10/1957 | Lawlor . | |
| 2,816,690 | 12/1957 | Lari . | |
| 2,859,932 | 11/1958 | Mackal . | |
| 2,924,041 | 2/1960 | Jackson et al. . | |
| 2,950,835 | 8/1960 | Alvear . | |
| 3,035,617 | 5/1962 | Breitenstein . | |
| 3,106,321 | 10/1963 | Gorman . | |
| 3,154,050 | 10/1964 | Hanson . | |
| 3,184,091 | 5/1965 | Hoffman . | |
| 3,223,117 | 12/1965 | Curie et al. . | |
| 3,233,411 | 2/1966 | Schubert . | |
| 3,237,809 | 3/1966 | Daragan et al. . | |
| 3,334,860 | 8/1967 | Bolton, Jr. . | |
| 3,464,436 | 9/1969 | Bruning | 137/237 |
| 3,477,105 | 11/1969 | Cranage | 24/230 |
| 3,768,501 | 10/1973 | Elson et al. | 137/231 |
| 3,871,404 | 3/1975 | Courant | 137/14.03 |
| 3,871,422 | 3/1975 | Elson et al. | 137/231 |
| 3,941,270 | 3/1976 | Spielman | 215/261 |
| 3,963,147 | 6/1976 | Waters | 222/95 |

(List continued on next page.)

FOREIGN PATENT DOCUMENTS

| | | | |
|---|---|---|---|
| 155098 | 10/1951 | Australia | 56.5/27.7 |
| 23412/35 | 8/1952 | Australia . | |
| 438454 | 12/1926 | Fed. Rep. of Germany | 64 C/27 |
| WO90/03919 | 4/1990 | PCT Int'l Appl. . | |

*Primary Examiner*—Gregory L. Huson
*Attorney, Agent, or Firm*—Julian Caplan

[57] ABSTRACT

A cap composed of a snap-on, tamper-evident closure differing from others of this general type is formed with a central sleeve. The bottom of the sleeve is closed off by a removable plug. The exterior of the closure is formed with a bead. The water dispenser is provided with an adapter consisting of an open-bottom outer sleeve into which the neck of the container with the closure in place thereon fits. Centrally disposed in the outer sleeve is a dispenser tube. When the container is inverted its neck is inserted in the outer tube. As the neck and cap are lowered, the dispenser tube enters the cap sleeve and attaches to the plug. Continued lowering of the container causes the plug to slide out of the tube so that liquid in the container flows out through the dispenser tube into the dispenser. When the container is lifted, the plug (which has been attached to the dispenser tube) is pulled back into its original sealed position. The plug and cup are at all times discrete. The exterior skirt of the plug and the interior wall of the well sleeve are seamless

7 Claims, 4 Drawing Sheets

U.S. PATENT DOCUMENTS

| | | | |
|---|---|---|---|
| 3,990,608 | 11/1976 | Walters | 222/91 |
| 4,014,461 | 3/1977 | Harvill | 222/94 |
| 4,022,258 | 5/1977 | Steidley | 141/330 |
| 4,098,438 | 7/1978 | Taylor | 222/529 |
| 4,137,930 | 2/1979 | Scholle | 137/68 |
| 4,159,790 | 7/1979 | Bailey | 222/211 |
| 4,165,769 | 8/1979 | Hoffmann | 141/198 |
| 4,182,388 | 1/1980 | Sellen | 141/351 |
| 4,239,130 | 12/1980 | Altadonna | 222/131 |
| 4,267,945 | 5/1981 | Maynard, Jr. | 222/83.5 |
| 4,286,636 | 9/1981 | Credle | 141/114 |
| 4,353,488 | 10/1982 | Schneiter et al. | 222/501 |
| 4,371,015 | 2/1983 | Simons | 141/352 |
| 4,380,310 | 4/1983 | Schneiter et al. | 222/501 |
| 4,391,308 | 7/1983 | Steiner | 141/18 |
| 4,421,146 | 12/1983 | Bond et al. | 141/349 |
| 4,445,551 | 5/1984 | Bond et al. | 141/349 |
| 4,557,399 | 12/1985 | Redick, Jr. | 222/83.5 |
| 4,576,313 | 3/1986 | Smith et al. | 222/81 |
| 4,597,423 | 7/1986 | Chenot | 141/330 |
| 4,699,188 | 10/1987 | Baker et al. | 141/18 |
| 4,717,051 | 1/1988 | Leclerc | 222/545 |
| 4,834,267 | 5/1989 | Schroer et al. | 222/185 |
| 4,846,236 | 7/1989 | Deruntz | 141/329 |
| 4,874,023 | 10/1989 | Ulm | 141/346 |
| 4,903,742 | 2/1990 | Gagnon | 141/353 |
| 4,972,976 | 11/1990 | Romero | 222/185 |
| 4,991,635 | 2/1991 | Ulm | 141/346 |
| 5,031,676 | 7/1991 | Ulm | 222/146.6 X |
| 5,121,778 | 6/1992 | Baker et al. | 222/146.6 X |

NON-SPILL BOTTLE CAP USED WITH WATER DISPENSERS

BACKGROUND OF THE INVENTION

1. Field of the Invention

This invention relates to a new and improved bottle cap used to close containers of the type used on water dispensers and water coolers. More particularly, the cap has tamper-evident features and, more specifically, is constructed so that it may be applied to conventional containers (e.g., 5-gallon water bottles) using conventional capping equipment. The cap is formed with an open well in the center which is initially closed by a slidable plug. The invention further comprises the use of such a cap with a dispenser system having a dispenser tube which fits into the well, engages the plug and pushes the plug away from the well to permit liquid to be dispensed from the container. When the container is empty or nearly empty, as the container is removed from the dispenser, the tube pulls the plug back into its initial position, preventing any liquid remaining in the container from spilling.

2. Description of Related Art

U.S. Reissue Pat. No. 32,354 discloses use of a flexible bag contained within a box fitted with an adapter which seals around an opening in the bag and is secured to an opening in the box. A tubular spigot probe is inserted into the adapter to engage a movable plug within a sleeve which is a permanent part of the adapter. As the probe is inserted into the sleeve, it seals thereagainst and also fastens itself to the plug. Continued insertion of the probe pushes the plug inwardly of the bag. When the probe is withdrawn, the plug is pulled back into the sleeve. The present invention constitutes an improvement over RE 32,354 in that the adapter of that patent is considerably modified so that it embodies a modification of a conventional bottle cap adapted to snap onto a conventional, large bottle for liquids such as water bottles. The box in which the bag is contained is entirely eliminated, in accordance with the present invention.

U.S. Pat. No. 4,699,188 shows a water dispensing system using a conventional large liquid container closed with a snap-on type cap having a well formed therein initially closed with a frangible bottom. The dispenser has a tube formed with a point which penetrates the bottom of the capped well and permits discharge of liquids through the dispenser tube. A disadvantage of the structure of this patent is that there is no means for reclosing the bottom of the well. Hence, when the container is removed, if any liquid remains therein it leaks through the pierced bottom of the capped well.

PCT Publication WO90/0399 discloses an improvement upon U.S. Pat. No. 4,699,188. In this structure, the bottom of the cap well is open and is initially closed by a plug integrally formed with the cap. When the container is installed in a dispenser, a tube of the dispenser fits into the well and engages the plug. Continued movement of the container causes the dispenser tube to break the connection between the plug and the well and push the tube into the container, allowing liquid to be dispensed through the tube. When the container is removed from the dispenser, the tube pulls the plug back into the well and then disengages therefrom, whereby the plug prevents leakage of the liquid. The present invention comprises an improvement on the above reference in that the plug is not formed initially as part of the well, but is a separate member inserted therein. Thus the present invention provides improved means for the plug engaging the dispenser tube and being disengaged therefrom when the plug is reinserted in the well. Further, the interfitting surfaces of the well and plug of the present invention are seamless and, therefore, smooth.

SUMMARY OF THE INVENTION

The present invention is used on adapters for liquid dispensers of a type commercially available. Such a dispenser adapter has an outward-flaring upper end which merges into a cylindrical lower end dimensioned to receive an inverted liquid container with the cap intact thereon. Centrally disposed in the cylindrical lower end of the adapter is a dispenser tube, the upper end of which is formed with a groove to interact with the plug of the cap as hereinafter described.

The container is a conventional container having a neck formed with a lip and has on its exterior a convex bead merging with the lip and a concave depression below the bead.

The cap of the present invention has certain features of conventional caps used to close such containers and is of a tamper-evident, snap-on type. Thus the cap is formed as a single injection molded member has a disk (annular in the present instance) which fits over the lip of the container neck, a rounded corner outward of the disk having internal seal beads which seal against the lip's surface and a skirt depending from the rounded corner. Part way down the interior of the skirt is a tension ring which fits against the underside of the neck bead and retains the cap on the neck even after the lower portion of the skirt has been torn away.

It will be understood that containers closed with caps according to the present invention are frequently used with dispensers other than those hereinafter described. In other words, the cap is removed from the container prior to installation in the dispenser. Furthermore, even when the cap has not been removed by the consumer, when the container has been returned to the bottling plant, it is necessary to remove the cap in order to refill the bottle. Accordingly, in accordance with the present invention, a finger grip depends from the lower edge of the cap skirt. Adjacent the finger grip is an upwardly curved score line which merges with a horizontal score line immediately below the closure tension ring. When the user grips the tear tab and pulls upwardly, the cap skirt tears along the curved score line and then at least partially around the horizontal score line, loosening the lower skirt from contact with the neck so that the cap may be removed. As illustrated in the accompanying drawings, there are internal radially spaced standoffs such as shown in U.S. Pat. No. 4,911,316 which engage the container neck. These standoffs facilitate installing the cap on the container neck and also prevent inward pinching of the cap skirt in the region of the concavity of the container neck.

The present invention differs from the caps of the above described type in that a central well is formed in the top of the cap, joined to the cap by a curved intermediate portion. The interior of the well near the bottom thereof is formed with an inner bead. The bottom of the well is open. Initially the well is closed by a plug. The plug has a top and a peripheral flange of a larger diameter than the interior of the well. Depending from the top disk of the plug is a skirt having an in-turned flange at its bottom edge and an external groove formed in the plug skirt. Initially the plug is inserted in the well, the inner wall of the well sealing against the outside wall of the plug skirt. The inner bead of the well snaps into the external groove of the plug to prevent unintentional dislodgment of the plug from the inside of the well.

Optionally, there is located on the exterior of the cap skirt an external cap bead. Although the dispenser preferably used with the present invention does not require the use of such a bead, the bead is of a greater outside diameter than any other portion of the cap and is intended to form a seal with a dispenser adapter of a different type than the preferred adapter.

The preferred adapter used with the present invention is conventional and has an outward diverging flared upper end which merges into a cylindrical lower end and is shaped to receive and center an inverted container capped with the cap of the present invention. Disposed centrally within the cylindrical lower end of the adapter is a dispenser tube. The upper end of the tube is preferably closed off and rounded. Immediately below the upper end of the tube is a groove shaped to engage the in-turned flange on the lower end of the cap plug. When the container is inverted and lowered into the adapter, the dispenser tube end penetrates the well of the cap and fits inside the skirt of the plug. When fully seated, the in-turned flange of the plug engages the groove of the dispenser tube to hold the two in position relative to each other. Continued lowering of the container causes the tube to push the plug out of the well and into the neck of the container. However, it will be understood that the plug does not float loose within the container, but is held attached to the upper end of the plug. There are dispensing holes in the dispenser tube through which liquid within the container flows and thence through the tube into the dispenser.

When the container is empty or at any time when it is desired to remove the container, it is lifted relative to the dispenser. The cap therefore retracts relative to the dispenser tube and the plug is pulled back into the well. Chamfers on the bottom edges of the well and plug facilitate the plug re-entering the well. When the peripheral flange on the plug engages the bottom edge of the well, the plug is pulled off of the dispenser tube, resealing the cap. Hence, if liquid remains in the container it does not leak.

The cap and plug of the present invention are injection molded of low density polyethylene, or other suitable plastic, each as a single piece in a mold which requires no slides, nor any welding of parts. Hence essential cooperating surfaces of the plug and mold are "seamless"—characterized by the absence of mold flash.

It will be understood that the cap of the present invention is tamper-evident. Initially a label covers the top of the cap. The label prevents dirt or liquids from entering the well and hence provides a sanitary protection for the cap. Additionally the label may contain the name of the bottler and any other information required by law or of other interest. Removal of the label gives some evidence of tampering. Moreover, it will be understood that if the plug in the bottom of the cap well is pushed into the container in order to tamper with the contents of the container, there is no means for replacing the plug. Hence, displacement of the plug is further evidence of tampering. The only way the plug can be returned into its initial position at the bottom of the well is by means of the dispenser tube as heretofore described.

One of the advantages of the invention is the fact that the cap may be used with conventional containers and no special container are required. Still another advantage of the invention is the fact that when the filled container is used with a dispenser other than that with which it is primarily intended, the cap may be removed by the consumer while the bottle is in upright position by gripping the tear tab and tearing the bottom of the skirt and then removing the upper portion of the cap.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENT

Figure 1:
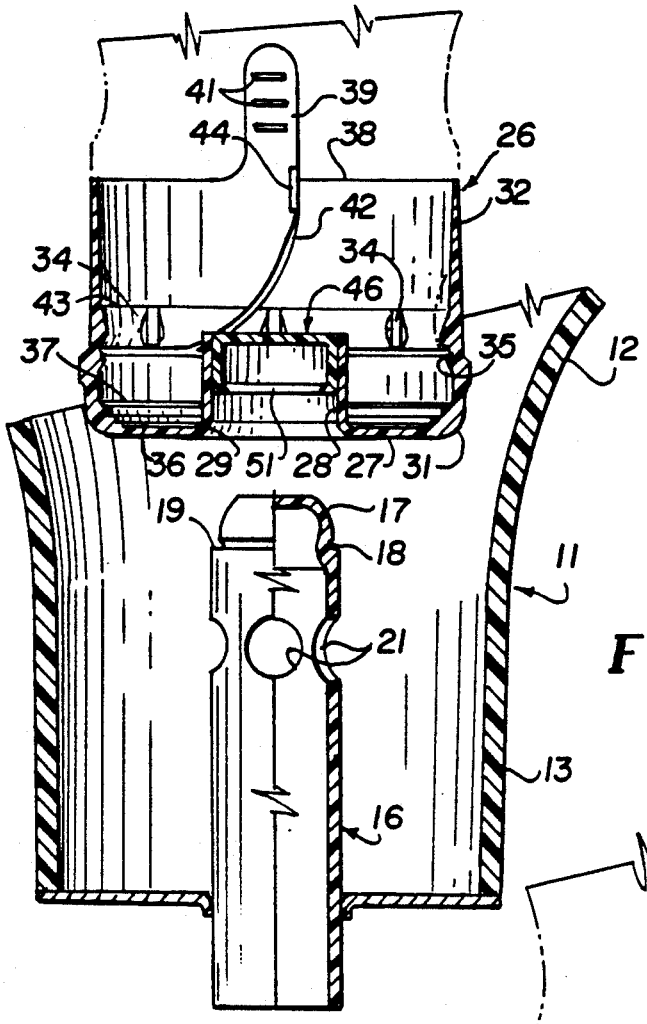
FIG. 1 is a schematic view showing a portion of a dispenser adapter and a cap in accordance with the present invention as the cap is being lowered into the dispenser; in this Figure the dispenser tube is partially broken away in section to reveal its internal construction.

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

An adapter 11 of a conventional type is used in a conventional water dispenser (not shown). The adapter 11 comprises an outwardly upwardly flaring upper end 12 and a vertical cylindrical lower end 13. The neck and shoulder of a conventional large water bottle (such as a 5-gallon water bottle conventionally used in the United States) when inverted fits within the dispenser. Disposed centrally of the lower end 13 is a dispenser tube 16 having a rounded closed upper end 17. The exterior of tube 16 has a groove 18 formed therein a short distance below the end 17 and has a shoulder 19 immediately below the groove 18. Below the shoulder 19, tube 16 is of larger diameter than end 17. There are four holes 21 in tube 16 through which water from the container installed in the dispenser may flow down through the bottom of the tube 16.

Cap 26 fits on a container neck 24. Cap 26 has an annular top 27 formed with a central well 28 having cylindrical side walls and extending down into the cap. A curved corner 29 connects the cylindrical well 28 with the annular disk 27. Adjacent the bottom of well 28 but spaced slightly upward thereof is an internal bead 30. Chamfer 40 is formed on the bottom of well 28.

The remainder of the cap 26 resembles a commercially available cap extensively used for large water containers which are not intended for use with dispensers of the type heretofore described. Such a cap has a rounded corner 31 disposed outwardly of the top 27 and below the corner 31 is a depending skirt 32. A tension ring 35 is located on the inside of the skirt 32 in a position to fit under the neck bead 97 of neck 24 and draw the corner 31 toward the neck bead. Preferably, there are upper and lower internal seal beads 36 on the inside of the wall of the corner 31 which tightly engage the container lip 96 and seal against leakage. Standoffs 34 are radially spaced apart and inward projecting to hold the wall of the skirt 32 outwardly of the concavity 98 of the container neck and also facilitate pushing the cap 26 onto the neck 24.

In order to loosen the lower portion of the skirt 32 so that cap 26 may be removed from neck 24, a tab 39 extends downward from the bottom edge 38 of the skirt 32 and is formed with transverse finger grip ridges 41 to facilitate pulling the tab. Curving upwardly from bottom edge 38 adjacent the tab 39 is an internal score line 42 which merges with a horizontal score line 43 immediately below tension ring 35. By pulling upward on the tab 39, the skirt tears along the score line 42 and thence along a sufficient portion of score line 43 so that the lower portion of skirt 32 releases its grip on neck 24. So long as the skirt 32 is intact on container neck 24, it is practically impossible to remove the cap 26. Once the lower portion of the skirt is loosened, the upper portion of the cap may be removed and used as a reclosure cap.

It will be understood that in the preferred practice of the present invention, the cap is not removed prior to installation of the container in the dispenser. However, many times the consumer may wish to use the container in a different type of dispenser. Further, after the container has been returned to the bottling works, it is necessary to remove the cap before the bottle is sterilized and refilled. Hence, the tab 39, score line 42 and 43 are used for such purposes. A buttress or internal thickening 44 is formed adjacent the intersection of bottom edge 38 and the bottom of score line 42 to prevent unintentional tearing of the skirt along any lines other than the line 42 and 43. The buttress 44 assists in confining the tear to the proper line.

In some instances the cap may be used in dispensers other than those heretofore described. In the preferred embodiment heretofore described, as hereinafter will appear, the exterior of the dispenser tube 16 fits tightly against the inside bore of the well 28. In some instances, however, it is desirable that the cap 26 seal against the inside of the equivalent of the cylindrical portion 13 of dispenser 11. For such purpose as well as for other purposes, external cap bead 58 is formed on the upper part of the skirt 32. The outside dimension of the bead 58 is greater than any other area of the cap 26.

For tamper-evident purposes a label 56 may be adhered to the top of the cap 26. Various labeling information such as the name of the bottler and information as to the contents of the container may be printed on the label 56. Further, the label covers the well 28 and prevents dirt, liquids or other contaminants from entering the well. Additionally, the label 56 is a tamper evident feature since once it is removed it gives evidence that there may be tampering with the contents of the container.

The lower end of well 28 is closed by a slidable plug 46.

Figure 5:
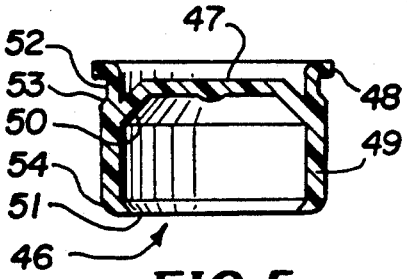
FIG. 5 is an enlarged sectional view of the plug used with the cap.
Figure 6:
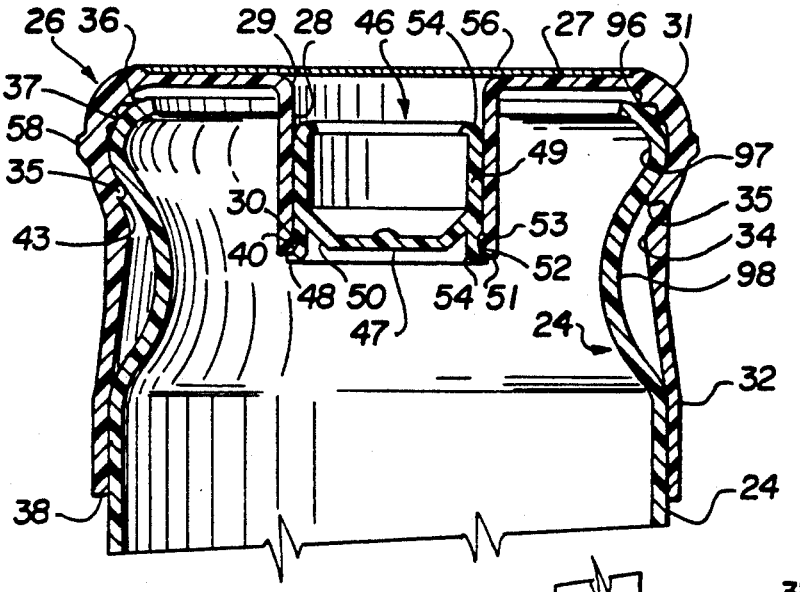
FIG. 6 is a fragmentary view of a container neck, cap and plug all assembled together.

Plug 46 has a closed disk end 47 at its center and, as shown in FIG. 5, downwardly outwardly slanted undercuts 50. Skirt 49 extends both above and below the outer ends of the undercut 50. At the upper end of skirt 49 is an outturned flange 48, the outer edge of which is of a larger diameter than any other portion of the plug. Below the flange 48 is a groove 52 having a shoulder 53 at its lower edge. At the lower edge of skirt 49 is a chamfer 54 and inward thereof is an inturned flange 51.

Plug 46 is preferably installed in the well 28 at the time of manufacture. The skirt 49 is snapped inside the well 28, the inner bead 30 entering groove 52 and being held therein by shoulder 53. Flange 48 abuts the bottom of the wall 28, limiting inward movement of plug 46.

The assembled cap 26 and plug 46 are shipped as a unit from the cap manufacturing facility. The cap 26 may be snapped onto the container neck 24 in the same manner and by the same equipment as used with conventional caps and necks. The cap is tamper-evident, first because the label 56 prevents tampering with the plug 46, and tension ring 35 and the engagement of skirt 32 with neck 24 prevent the cap from being removed from the container neck until the skirt is torn away.

Further evidence to tampering is afforded by the presence or absence of plug 46. Only by use of a dispenser may the plug be re-positioned in well 28 once it has been removed.

Upon delivery of the bottled liquid to the site of the dispenser, the label 56 is removed. Contrary to conventional dispensers, in accordance with the present invention the cap 26 remains on the neck 24. The container is inverted and lowered into the dispenser. As shown in FIG. 1, the container remains sealed and hence liquid does not spill from the container during the period of time when the container is being lowered into the dispenser.

Figure 2:
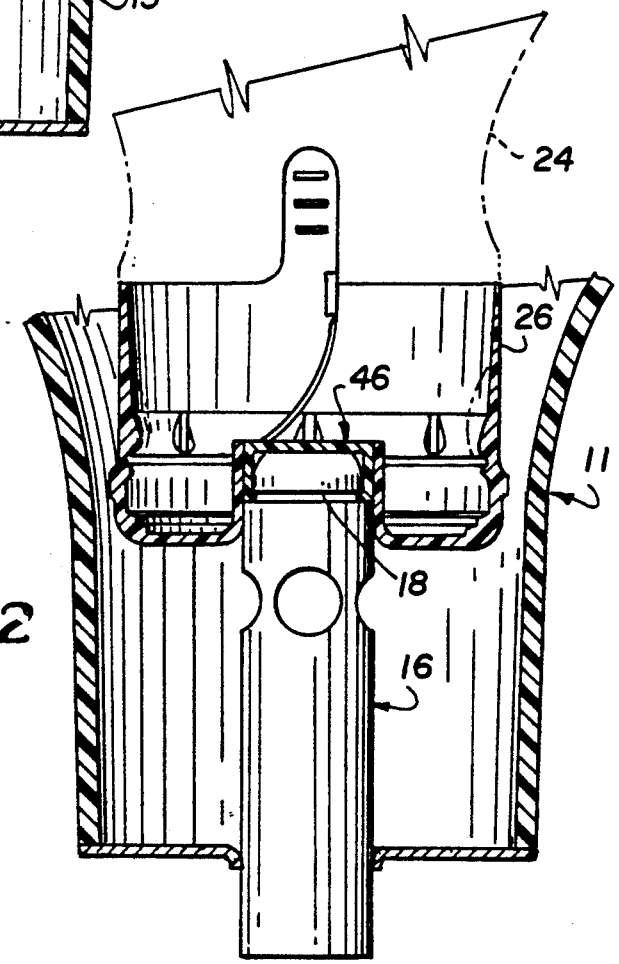
FIG. 2 is a view similar to FIG. 1 showing the cap in the position where it engages the dispenser tube and the plug of the cap is attached to the tube.

When the container is lowered to the position of FIG. 2, the dispenser tube 16 has entered the well 28 and sealed thereagainst. The smaller diameter rounded upper end 17 has entered inside the plug skirt 49 and the in-turned flange 51 on the bottom edge of the plug skirt has seated in the groove 18.

Figure 3:
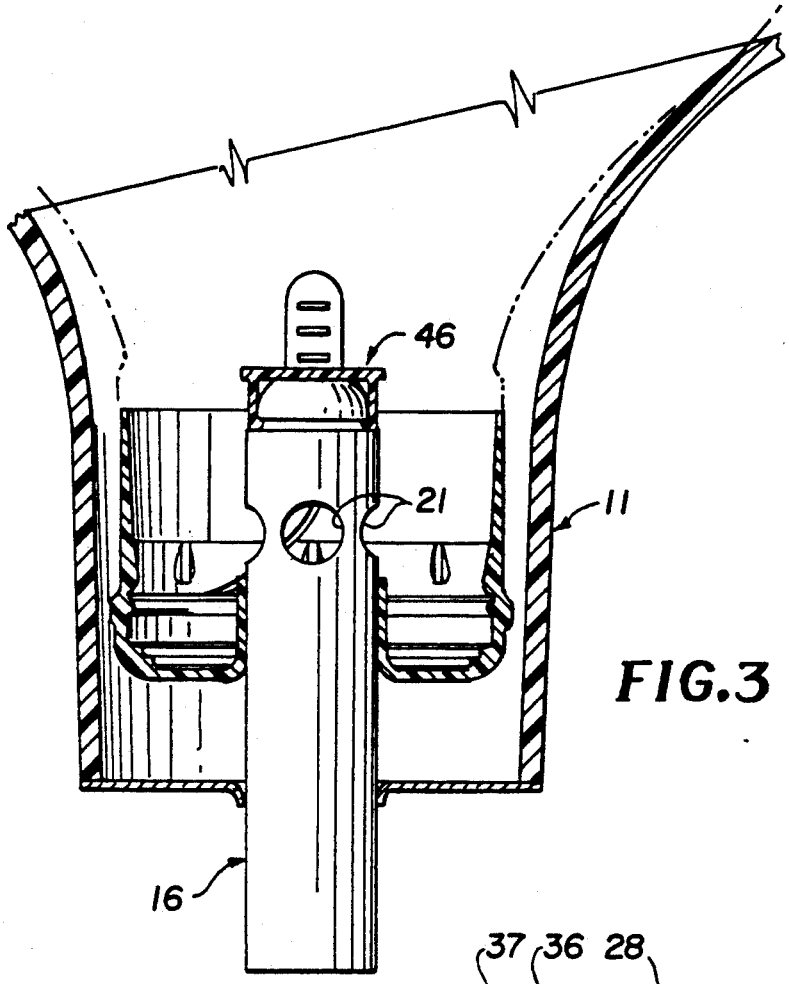
FIG. 3 is a view similar to FIG. 2 showing completion of the insertion of the cap into the adapter, the plug being shown separated from the cap well.

As the cap and container are lowered to the open position of FIG. 3, the plug 46 is forced upwardly out of the well 28. The holes 21 in the tube 16 communicate with the inside of the container and hence liquid can flow through the holes 21 and down through the tube 16 into the dispenser. It will be noted that the plug 46 is firmly gripped on the upper end of the tube 16 and does not float inside the container.

After the contents of the container have been wholly or partially dispensed, the user may remove the container from the dispenser. This operation is the reverse of the previous operations. That is, the container is lifted from the position of FIG. 3 to the position of FIG. 2. Because the in-turned flange 51 of the plug 46 is engaged in the groove 18 of the tube 16, the plug is pulled back into the well 28, chamfers 40 and 54 facilitating entry. Plug 46 snaps in place because of interfitting of bead 30 in groove 52. Continued movement from the position of FIG. 2 to the position of FIG. 1 causes the flange 51 to snap out of the groove 18. Inward movement of the plug 46 relative to well 28 is prevented because of the peripheral flange 48 on the plug. In the position of FIG. 1, the plug 46 prevents leakage of any liquid remaining in the container while the container is being removed and returned to upright position.

When the container is returned to the bottling works, the tab 39 is gripped causing the skirt to tear along the line 42 and partially along line 43. This permits the cap to be removed so that the container may be sterilized, refilled and then recapped.

Plug 46 is manufactured in a standard injection molding machine and employs standard plates and standard actuation of such plates, but the cavities in the plates are so located that it is possible to mold the plug without the use of slides. The use of slides, particularly if the plates are not perfectly supported or if through passage of time the plates and their actuators wear, tends to cause flash or a seam to form on the part. The presence of such a seam on the exterior of the skirt 49 would cause leakage and create difficulty in the plug sliding in and out of the well 28.

FIGS. 8 through 11 show sequentially and schematically construction of the various mold parts and the sequence of the action thereof. It will be understood that the parts are not described in detail since such details of construction would be understood by expert injection mold designers. What is shown, however, in these drawings are the major features of the construction of the mold parts which makes forming the part without a seam feasible.

The mold comprises a hot side mold part 71 cored out for hot runner 72. The bottom of the part 71 has a protrusion 73 formed with a recessed portion 74. The portions 73 and 74 define the upper end of plug 46, namely, the closed end 47, undercut 50, and the inside surface of flange 48. Gate 76 is formed in the center of protrusion 73 for the discharge of molten plastic. A preferable plastic used in the construction of the cap and the plug is low density polyethylene.

Figure 10:
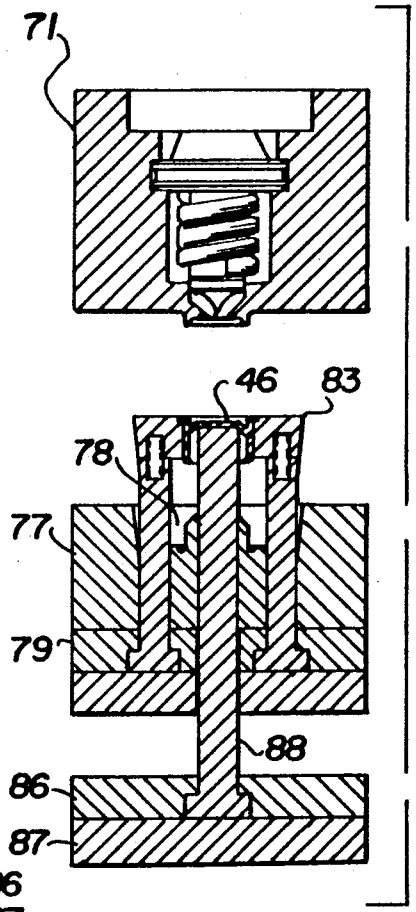
Figure 9:
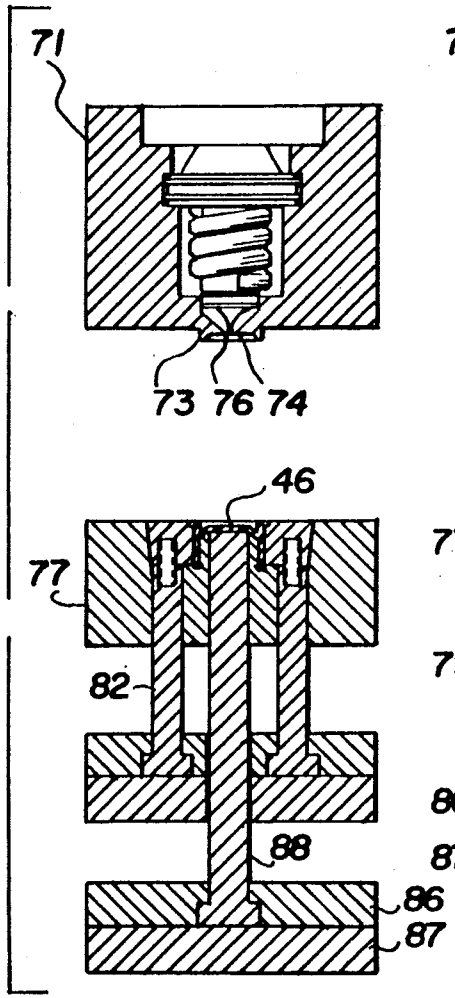

Abutting the bottom face of mold part 71 is core plate 77 formed with essentially annular core cavity 78 (see FIG. 10). The inner surface of cavity 78 determines the shape of the underside of plug undercut 50 and the inside of skirt 49 as well as the shape of in-turned flange 51. Below plate 77 is first stage ejector clamp plate 79 and below plate 79 is first stage ejector support plate 81. Between plates 79 and 81 are clamped the lower ends of ejector ring pins 82. On the upper end of pins 82 is the ejector ring 83 which is formed with a cavity 84 (see especially FIG. 11) which is complementary to the exterior of plug flange 48, groove 52 and the outside of skirt 49.

Below plate 81 is second stage ejector plate 86 and below that is the second stage ejector support plate 87. Between them they clamp the lower end of ejector pin 88.

Figure 11:
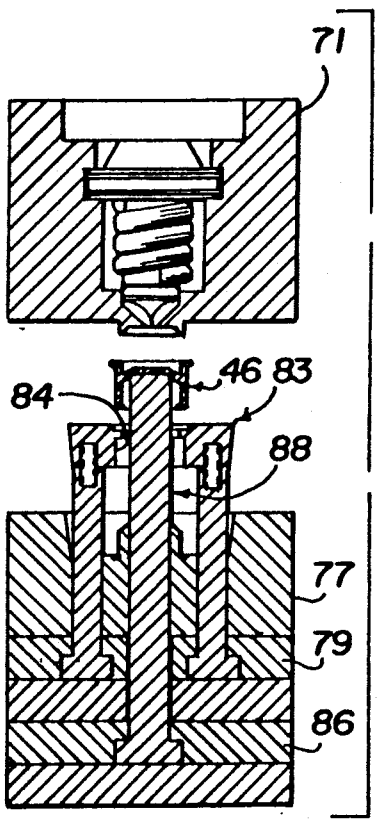
FIGS. 9, 10 and 11 are views similar to FIG. 8 showing parts in sequential positions of the molding operation.
Figure 8:
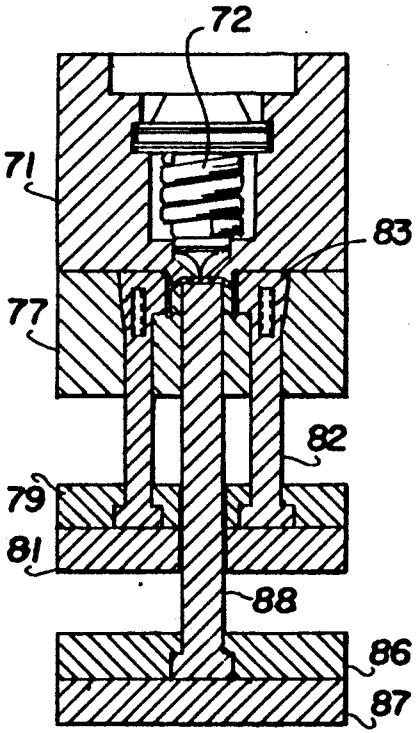
FIG. 8 is a schematic sectional view showing a plug and mold parts for producing same at a first stage in molding the plug.

In operation, the parts are in the condition shown in FIG. 8 during the molding of plug 46. The crosssectional shape of plug 46 is shown in solid block lines in FIGS. 8–11. After the plastic flowing through gate 76 has completely filled the mold, the hot side mold part 71 is withdrawn to the position of FIG. 9. The next stage in operation of the mold is shown in FIG. 10 whereby plates 79 and 81 are moved upward, causing the pins 82 to raise the ejector ring 83. This operation strips the plug 46 from contact with the core 77. The final stage of operation is shown in FIG. 11 whereby the plates 86 and 87 have been projected causing the ejector pin 88 to push the plug 46 out of the ejector ring 83. The plug 46 then drops off the pin 88 and the mold parts return to the position of FIG. 8 for the next cycle of operation.

Figure 7:
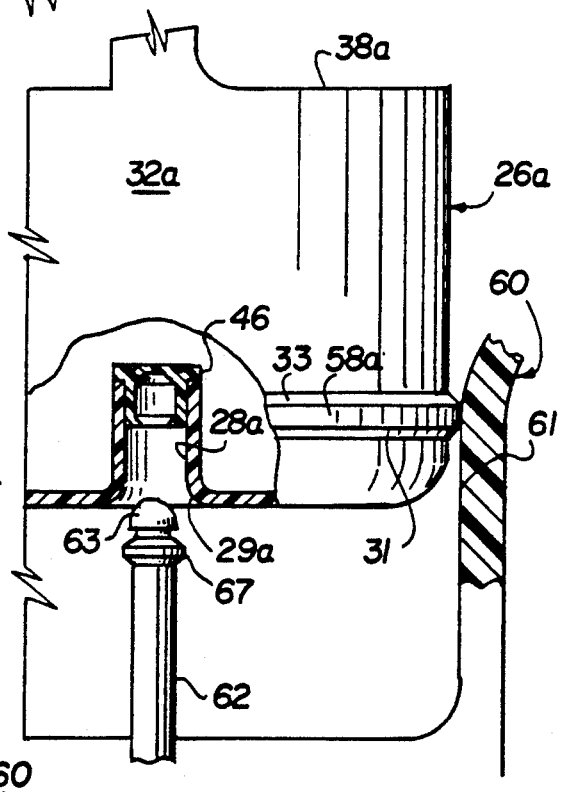
FIG. 7 is a view similar to FIG. 2 of a modified dispenser adapter.
Figure 7A:
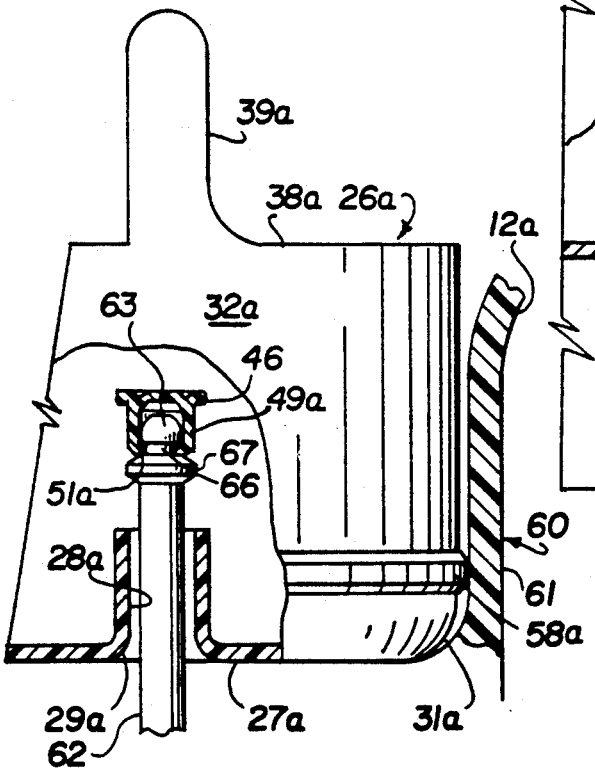
FIG. 7A is a view similar to FIG. 7 showing the plug separated from the cap well.

FIG. 7 illustrates use of the cap of the present invention with a different type water dispenser. The dispenser has a cylindrical sleeve 60 within which is an upward extending rod 62. Sleeve 60 has an inside diameter which has an interference fit with the external cap bead **58*a* so that the cap 26*a* seals against the cylindrical portion 61 of the sleeve 60. Rod 62 is of a smaller diameter than the tube 16 of the previous modification so that it does not seal against the inside of the well 28*a*. The upper end 63 of the rod 62 is sufficiently small to fit inside the plug skirt 49*a* and the in-turned flange 51*a* seats in the groove 66. Immediately below groove 66 is an enlarged diameter portion 67 which stretches well 28*a* so that plug skirt 49*a* may re-enter well 28*a* when the container is withdrawn from dispenser sleeve 60**.

It will be noted that in this modification the seal is by means of the external cap bead 58 against the inside of the cylindrical portion 61 of the sleeve 60 and liquid is dispensed by running down the outside of rod 62. In other respects, the modification of FIG. 7 resembles that of the previous modification and the same reference symbols indicate corresponding parts.

Figure 4:
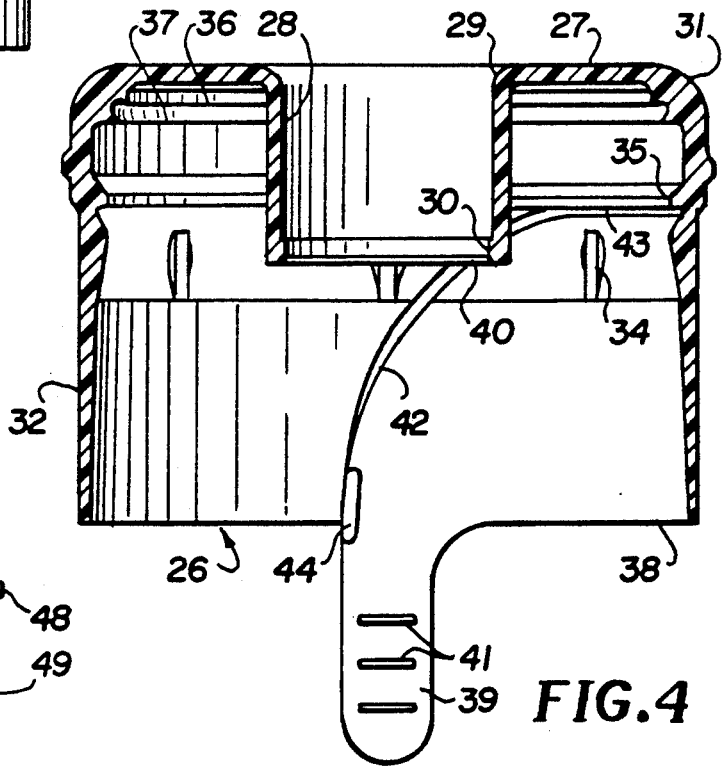
FIG. 4 is an enlarged sectional view of the cap in accordance with the present invention.

For convenience in explanation and accurate definition in the appended claims, the terms "up" or "upper" and "down" or "lower" to describe features of cap 26 and plug 46 refer to the positions of those members displayed in FIGS. 4 and 5, respectively.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A closure for a container of the type having a neck formed with a lip and a surrounding bead comprising a unitary cap having a seamless cap top shaped to fit over said neck formed with a well having a seamless cylindrical interior side wall and an open bottom a cap skirt depending from said top shaped to fit around said lip and bead and having cap retention means cooperable with said neck to hold said cap on said neck in liquid-tight manner, a plug for said well having a plug top and a cylindrical member surrounding and attached to said plug top, said cylindrical member comprising a plug skirt, a flange projecting outward from said cylindrical member larger than the inside of said well to limit inward movement of said plug relative to said well, the outside wall of said plug skirt being smaller in diameter than said flange and said cylindrical member being formed with a circumferential groove immediately below said flange, said plug skirt having a portion having an outside diameter dimensioned to form with said interior side wall of said well a liquid-tight fit, said plug top being formed with a closed end smaller than said plug skirt and downward-outward directed flanks merging with said plug skirt below the level of said groove, there being a space between said flanks and said cylindrical member opposite said circumferential groove to permit said cylindrical member to collapse inwardly at said circumferential groove.

said well being formed adjacent its lower edge with an in-turned inner bead adapted to snap into said groove to hold said plug in said well against unintentional dislodgment, said plug skirt being characterized by the fact that it has an outside surface with no vertical seam thereon, said well being characterized by the fact that said well has no vertical, said cylindrical member vicinal said groove being flexible, whereby said cylindrical member may be collapsed inwardly.

2. A closure according to claim 1 in which said cap retention means comprises a rounded corner curving downward-outward outwardly of said cap top, a pair of inwardly projecting circumferential seal beads on the inside of said rounded corner, said corner being intermediate said cap top and said cap skirt, and a tension ring on the inside of said skirt positioned to fit under the bead of said neck and draw said seal beads tightly against said neck lip and bead.

3. A closure according to claim 1, wherein the outside of said cylindrical member below said groove is formed with a shoulder to impede withdrawal of said plug from said well.

4. In combination, a closure according to claim 1 and a dispenser tube having a rube end smaller than the inside of said plug skirt and a circumferential tube groove below said tube end, said closure plug further comprising an in-turned flange at the lower edge of said plug skirt shaped to fit into said dispenser tube circumferential groove to detachably secure said plug to said tube when said tube end is fully inserted inside said plug skirt.

5. The combination of claim 4 wherein said dispenser tube below said tube groove is dimensioned to fit inside said well with a sliding, liquid-tight fit.

6. A combination according to claim 4 which further comprises an adapter having a cylindrical portion surrounding said dispenser tube and wherein said cap skirt has an outside bead dimensioned to fit inside said cylindrical portion with a sliding, liquid-tight fit.

7. The combination of claim 4 wherein the inside of the lower end of said well is formed with a first chamfer and the outside of said plug skirt is formed with a second chamfer at its lower end, said chamfers facilitating insertion of said plug in said well.

* * * * *